US012679578B2

(12) United States Patent
Cichy

(10) Patent No.: US 12,679,578 B2
(45) Date of Patent: Jul. 14, 2026

(54) APPARATUS AND METHOD FOR VACUUM SEALING PHARMACEUTICALS INTO CONTAINERS

(71) Applicant: VANRX PHARMASYSTEMS INC., Burnaby (CA)

(72) Inventor: Marcin Czeslaw Cichy, Surrey (CA)

(73) Assignee: VANRX PHARMASYSTEMS INC., Burnaby (CA)

( * ) Notice: Subject to any disclaimer, the term of this patent is extended or adjusted under 35 U.S.C. 154(b) by 0 days.

(21) Appl. No.: 18/877,473

(22) PCT Filed: Jun. 25, 2023

(86) PCT No.: PCT/US2023/026177
§ 371 (c)(1),
(2) Date: Dec. 20, 2024

(87) PCT Pub. No.: WO2024/006175
PCT Pub. Date: Jan. 4, 2024

(65) Prior Publication Data

US 2025/0376281 A1 Dec. 11, 2025

Related U.S. Application Data

(60) Provisional application No. 63/412,404, filed on Oct. 1, 2022, provisional application No. 63/358,143, filed
(Continued)

(51) Int. Cl.
*B65B 3/00* (2006.01)
*B65B 7/28* (2006.01)
*B65B 31/02* (2006.01)

(52) U.S. Cl.
CPC ..... *B65B 3/006* (2013.01); *B65B 7/2807* (2013.01); *B65B 31/028* (2013.01); *B65B 2210/06* (2013.01)

(58) Field of Classification Search
CPC ..... B65B 3/006; B65B 7/2807; B65B 31/028; B65B 2210/06; B65B 55/027; B65B 3/003; B65B 7/2821
(Continued)

(56) References Cited

U.S. PATENT DOCUMENTS 2,823,500 A 2/1958 Franke
4,729,208 A * 3/1988 Galy ..... A61M 5/00 53/328
(Continued)

FOREIGN PATENT DOCUMENTS

FR 2606767 A1 5/1988
WO 2015048862 A1 4/2015
(Continued)

OTHER PUBLICATIONS

PCT International Search Report of The International Searching Authority for PCT/US2023/026177, dated Nov. 14, 2023.
(Continued)

*Primary Examiner* — Andrew M Tecco
*Assistant Examiner* — Nicholas E Igbokwe
(74) *Attorney, Agent, or Firm* — Kevin R. Erdman; Brannon Sowers & Cracraft PC

(57) ABSTRACT

The present invention involves a sterilizable vacuum chamber that provides for sealing a pharmaceutical fluid into a plurality of containers, the chamber comprising a vertically movable container nest holder for holding a container nest bearing a plurality of pharmaceutical containers filled with a pharmaceutical fluid, a container closure nest holder for holding a closure nest bearing a plurality of corresponding container closures and for locating a closure vertically above each corresponding container, a ram for vertically moving the container nests to engage the containers with corresponding closures, and an elastically deformable closure
(Continued)

nest restraining element disposed on an opposing side of the closure nest from the container nest. A method is provided for sealing the pharmaceutical fluid into the containers. The method comprises the closure nest restraining element acting on the closure nest to oppose any vertical upward motion of any of the plurality of containers after the engaging of the containers with the closures.

26 Claims, 6 Drawing Sheets

Related U.S. Application Data on Jul. 3, 2022, provisional application No. 63/355,640, filed on Jun. 26, 2022.

(58) Field of Classification Search
USPC ..... 53/471, 432, 510, 299
See application file for complete search history.

(56) References Cited

U.S. PATENT DOCUMENTS 4,774,772 A * 10/1988 Vetter ..... B08B 9/423 34/106
5,185,985 A * 2/1993 Vetter ..... A61M 5/008 53/328
5,519,984 A * 5/1996 Beussink ..... B65B 3/003 53/489
11,801,956 B2 * 10/2023 Degliesposti ..... B65B 3/003
2015/0013276 A1 * 1/2015 Okajima ..... A61L 2/07 53/471
2015/0190578 A1 * 7/2015 Okihara ..... B65B 7/2821 53/111 R
2016/0200461 A1 * 7/2016 Broadbent ..... B65B 7/2821 53/426
2017/0081056 A1 * 3/2017 Zambaux ..... A61M 5/30
2019/0337658 A1 * 11/2019 Diaz Guerrero ..... B65B 55/10
2021/0047064 A1 * 2/2021 Diaz Guerrero ..... B65B 55/027
2021/0093510 A1 * 4/2021 Kloke ..... A61J 1/2003

FOREIGN PATENT DOCUMENTS

WO 2019071339 A1 4/2019
WO 2019213746 A1 11/2019

OTHER PUBLICATIONS

PCT International Written Opinion for PCT/US2023/026177, dated Nov. 14, 2023.

* cited by examiner

APPARATUS AND METHOD FOR VACUUM SEALING PHARMACEUTICALS INTO CONTAINERS

CROSS-REFERENCE TO RELATED APPLICATIONS

This application is a U.S. National Stage Application under 35 U.S.C. § 371(b) of International Application Serial No. PCT/US2023/026177, filed Jun. 5, 2023, which claims priority under 35 U.S.C. § 119(e) to U.S. Provisional Application No. 63/412,404, filed on Oct. 1, 2022, and U.S. Provisional Application No. 63/358,143, filed on Jul. 3, 2022, and U.S. Provisional Application No. 63/355,640, filed on Jun. 26, 2022, the entire disclosures of which are incorporated herein by reference.

TECHNICAL FIELD

This present invention relates to the medical field as exemplified by IPC class A61 and more particularly to apparatus and associated methods for sterilization of and sterile handling of pharmaceutical materials and containers for pharmaceuticals, including bringing pharmaceuticals into form for administration to medical or veterinary patients. In one aspect, it relates to the filling of pharmaceutical containers with predetermined amounts of liquid or other materials and for sealing such materials into the containers.

BACKGROUND

Controlled environment enclosures are known in the art. Such enclosures are used, for example, for containment of hazardous materials. In other examples, controlled environment enclosures are used to provide controlled environments with limited numbers of particulates.

In the art, controlled environment enclosures are typically fitted with ports for transfer of materials in and out of the enclosure and the ports are fitted with gloves for manual manipulation of equipment, parts or materials inside the enclosure. Such gloves are subject to significant risk of puncture.

In some examples known in the art the controlled environment enclosure is also used to limit exposure to viable particulates. Such controlled environment enclosures may be required for aseptic processing of cell cultures and for the manufacture of pharmaceutical products, medical devices, food or food ingredients. In these cases, it is a requirement that the controlled environment enclosure be decontaminated. This may be done thermally using steam or chemically using chemical agents. Suitable chemical agents known in the art include hydrogen peroxide, ozone, beta-propiolactone, aziridine, formaldehyde, chlorine dioxide, ethylene oxide, propylene oxide, and peracetic acid. In most cases the decontamination and sterilization operations have to be preceded by a cleaning process. Such cleaning processes have the function of removing major contamination by simple mechanical and chemical action.

In some examples in the prior art the controlled environment also contains automated equipment. Such automated equipment includes machines for filling of vials. The automated equipment located in the controlled environment is typically of such a size and complexity that it cannot be operated fully automatically without human intervention. Such human intervention typically requires the use of gloves with the associated risk of puncture.

In view of the above there remains a need for controlled environments that do not require human intervention via the use of gloves and in which pharmaceutical fluids may be accurately and aseptically dispensed and sealed into containers. This is particularly true in the case of pharmaceutical fluids that are required to be vacuum sealed into syringes or cartridges. This is an area where mechanical challenges remain in the sealing process and where much effort has to be devoted to preventing any trapped air bubbles potentially harmful to patients to be injected with the pharmaceutical fluids.

SUMMARY OF THE INVENTION

A method is provided within a sterilizable chamber for sealing a pharmaceutical fluid into a plurality of containers with a corresponding plurality of closures, the method comprising: transferring into an isolator that is in spatial communication with the chamber via a sealable portal the plurality of containers held in a container nest and the corresponding plurality of closures held in a closure nest; establishing within both the chamber and the isolator an aseptic condition; in the isolator under the aseptic condition filling the plurality of containers with the pharmaceutical fluid; transferring into the chamber the container nest holding the pharmaceutical-filled containers and the closure nest holding the corresponding closures; disposing within the chamber the closure nest above the container nest such that every container to be sealed is aligned and/or located concentrically below a corresponding closure; vacuum-tight sealing the chamber by means of the portal; reducing an air pressure in the chamber to a predetermined level to create a vacuum condition; mechanically engaging the plurality of containers with the corresponding closures under the vacuum condition by forcing the container nest vertically upward; opposing by means of the closure nest any vertical upward motion of any one of the plurality of containers after the engaging; and increasing the air pressure in the chamber to force the plurality of closures deeper into the corresponding plurality of containers to establish physical contact between the closures and the pharmaceutical fluid.

Opposing any vertical upward motion of any one of the plurality of containers may comprise restraining the closure nest by means of a mechanical element of the sterilizable chamber disposed on an opposing side of the closure nest from the container nest. Opposing any vertical upward motion of any one of the plurality of containers may comprise restraining the closure nest by elastic deformation of a mechanical element of the sterilizable chamber disposed on an opposing side of the closure nest from the container nest. The elastic deformation may comprise elastic compression or spring-based compression. Opposing any vertical upward motion of any one of the plurality of containers may comprise mechanically confining the closure nest along a vertical axis.

The vacuum-tight sealing of the chamber may comprise vacuum-tight sealing to a leak rate equal or less than 1.54 millibar·liter per second. In some embodiments, the vacuum-tight sealing the chamber may comprise vacuum-tight sealing to a leak rate equal or less than 0.3 millibar·liter per second. In yet other embodiments, the vacuum-tight sealing the chamber may comprise vacuum-tight sealing to a leak rate equal to or less than 0.02 millibar·liter per second.

A sterilizable vacuum chamber is provided for sealing a pharmaceutical fluid into a plurality of containers with a corresponding plurality of closures, the chamber comprising: a vertically movable container nest holding facility arranged for receiving a container nest bearing a plurality of pharmaceutical containers filled with a pharmaceutical fluid; a container closure nest holding facility arranged for receiving a closure nest bearing a plurality of corresponding container closures and for locating a closure vertically above each corresponding container in the container nest; a ram for vertically moving the container nest holding facility to engage containers in the container nest with closures in the closure nest; and a closure nest restraining element disposed on an opposing side of the closure nest from the container nest.

The sterilizable vacuum chamber may be sealable to a leak rate equal to or less than 1.54 millibar·liter per second. In other embodiments, the chamber may be sealable to a leak rate equal to or less than 0.3 millibar·liter per second. In yet other embodiments, the chamber may be sealable to a leak rate equal to or less than 0.02 millibar·liter per second. The closure nest restraining element may be elastically deformable so as to be able to move between a first undeflected configuration to a second deflected configuration and back again as the container nest is moved towards and away from the closure nest. The closure nest restraining element may be elastically compressible or may comprise at least one compressible spring. The closure nest restraining element may be disposed to deform elastically when the closure nest is forced vertically upward against the restraining element. The closure nest restraining element may be disposed to mechanically confine the closure nest along a vertical axis.

The elastically deformable closure nest restraining element may be disposed to engage the container nest. The container nest holding facility and the closure nest holding facility may be aligned. The container nest holding facility and the closure nest holding facility may be disposed to hold the container nests and the closure nests in alignment. The alignment of the container nest holding facility and the closure nest holding facility may be arranged to concentrically locate corresponding container nests and closure nests.

The sterilizable vacuum chamber may further comprise a sealable portal disposed for receiving the container nest bearing the plurality of pharmaceutical containers and the closure nest bearing the plurality of corresponding container closures.

Another aspect of the invention involves an elastically deformable closure nest restraining element to be positioned proximate opposing elements of a closure nest and a container nest. Such a device relates to a sterilizable vacuum chamber for sealing pharmaceutical fluids into containers, for example without limitation tubular and/or cylindrical containers. Such a deflectable flexure element may extend near the closure nest and the container nest. It may provide a surface in facing opposition to one of said closure nest and container nest, for example without limitation a concave, convex, and/or undulating surface. Such a deflectable element may further include a second deflectable element, for example without limitation having concave, convex, and/or an undulating surface in facing opposition to at least one of the closure nest and container nest. Such a flexure may mechanically bias the closure nest and the container nest, for example without limitation by moving between a first undeflected configuration to a second deflected configuration as the container nest is moved towards the closure nest. In other embodiments the closure nest may push against the containers and, in some cases, indirectly (via the containers) against the container nest if the latter was dragged upward with the containers by the returning air pressure acting on the closures. Such an arrangement may position, engage, insert, and/or seal etc. at least one closure of the closure nest with an opening of a corresponding container in the container nest to facilitate processing of the nests. Such a flexure may further move back to the undeflected configuration when the nest is moved away from the closure nest, and may be mounted to and/or with one of the closure nest and container nest or a corresponding portion of the holding facility.

Other features, elements, steps, characteristics and advantages of the present invention will become more apparent from the following detailed description of preferred embodiments of the present invention.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

Figure 1A:
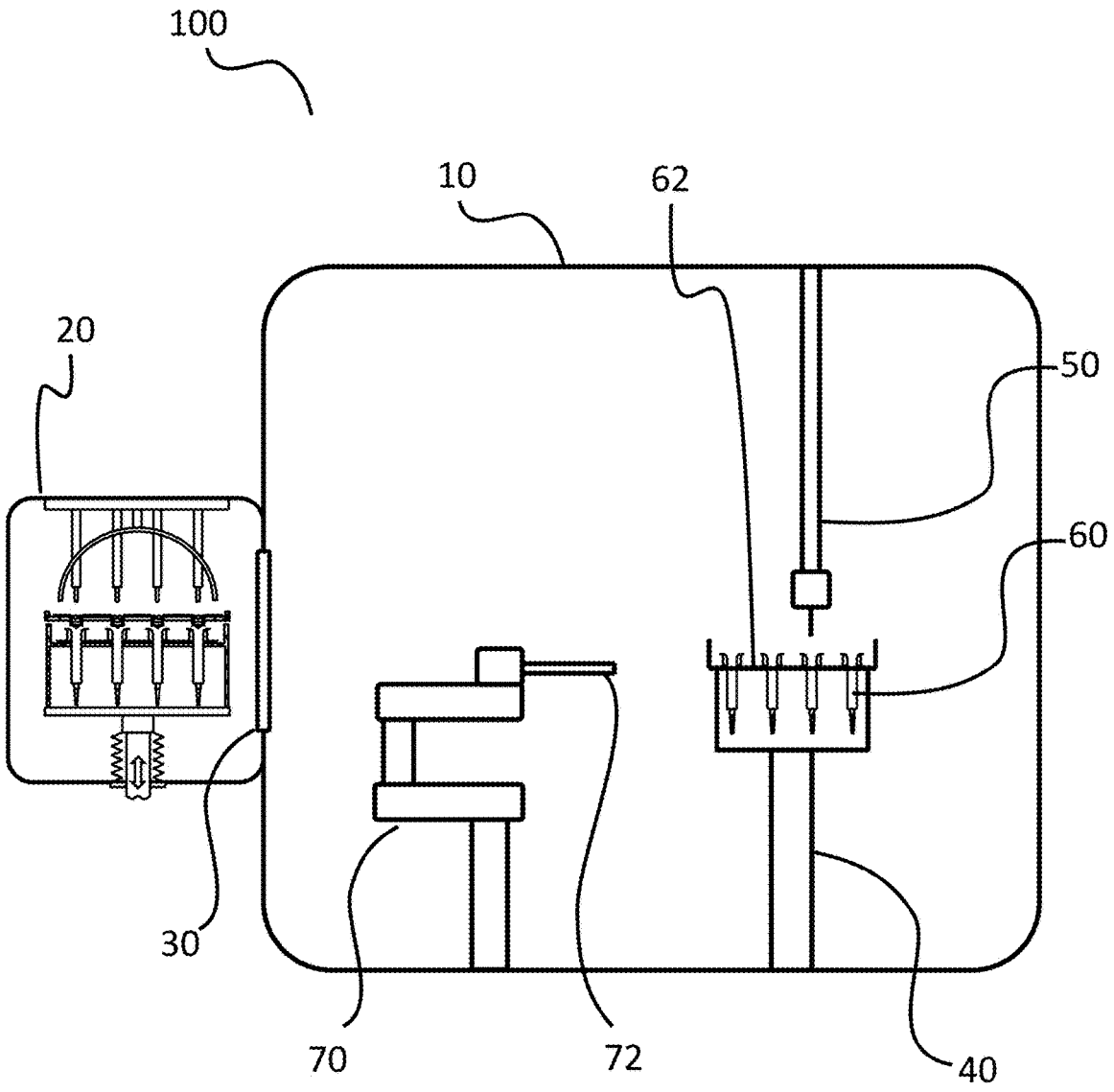
FIG. 1A is a schematic drawing of an apparatus for filling syringes with a pharmaceutical fluid and vacuum sealing the fluid into the syringes by means of closures.

Corresponding reference characters indicate corresponding parts throughout the several views. Although the drawings represent embodiments of the present invention, the drawings are not necessarily to scale and certain features may be exaggerated in order to better illustrate and explain the present invention. The flow charts are also representative in nature, and actual embodiments of the invention may include further features or steps not shown in the drawings. The exemplification set out herein illustrates an embodiment of the invention, in one form, and such exemplifications are not to be construed as limiting the scope of the invention in any manner.

DETAILED DESCRIPTION

The embodiments disclosed below are not intended to be exhaustive or limit the invention to the precise form disclosed in the following detailed description. Rather, the embodiments are chosen and described so that others skilled in the art may utilize their teachings.

Figure 1B:
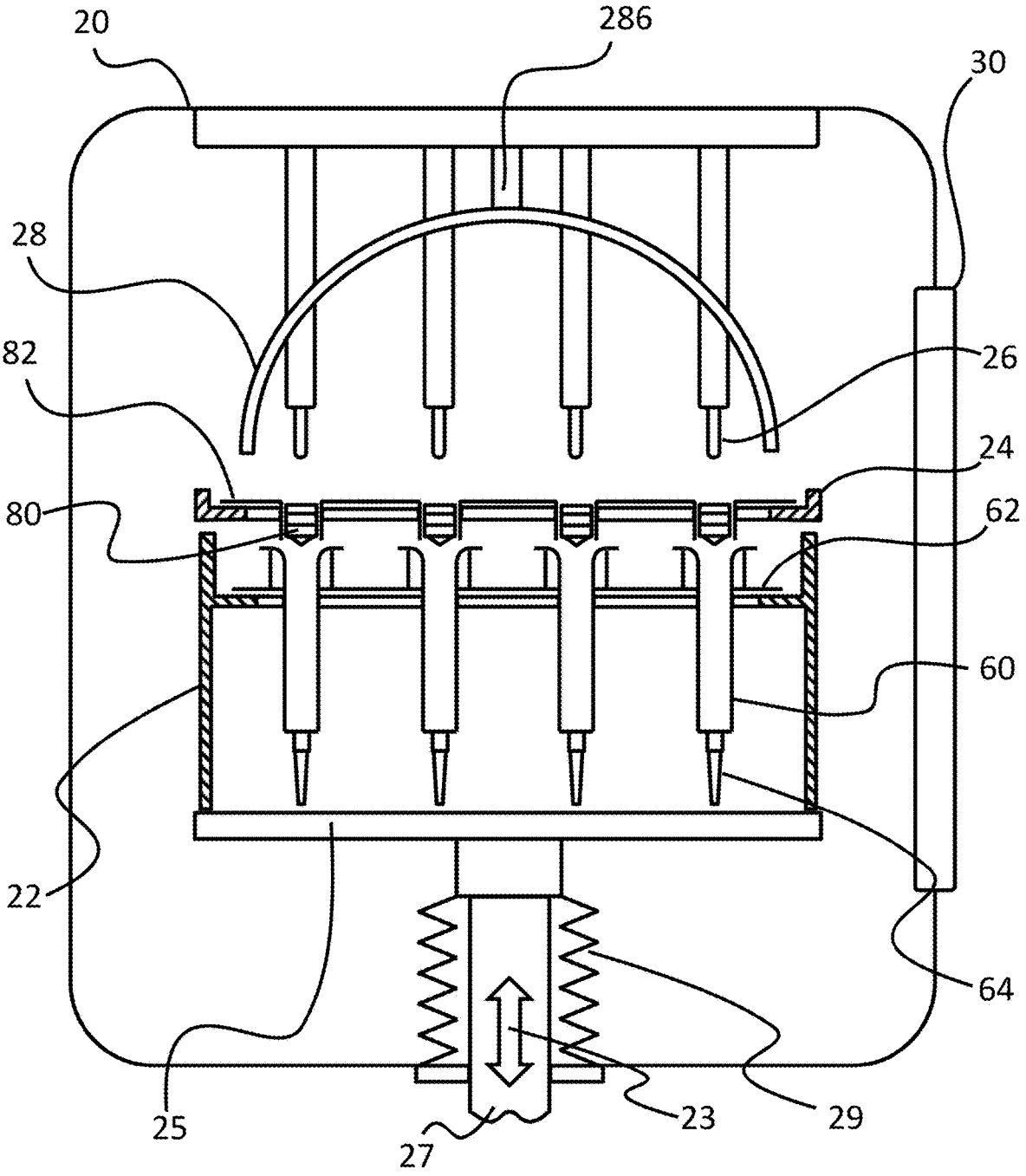
FIG. 1B shows detail of one chamber of the apparatus of FIG. 1A.
Figure 1C:
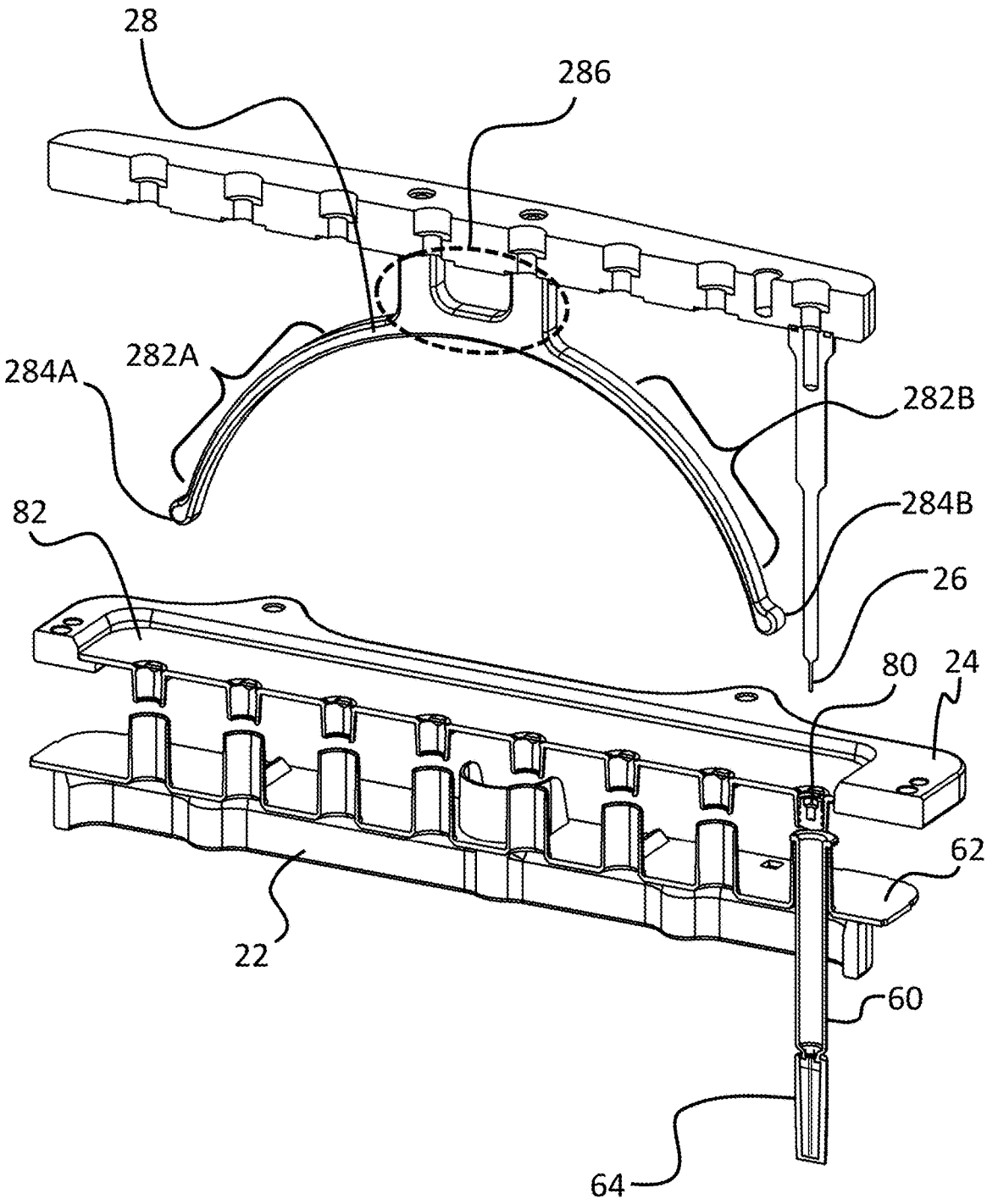
FIG. 1C is a cross-section in a vertical plane of an implementation of the container sealing arrangement shown in FIG. 1B.

FIG. 1A, FIG. 1B, and FIG. 1C show an embodiment of apparatus 100 for filling containers with a pharmaceutical fluid and vacuum sealing the fluid into the containers by means of closures. Apparatus 100 comprises at least two chambers 10 and 20. Chamber 20 may be sealed vacuum tight from chamber 10 by portal 30. The interiors of chambers 10 and 30 are both capable of being sterilized with portal 30 open and are configured for maintaining an aseptic condition established by the sterilization. Chamber 20 may be equipped with an air pressure control subsystem (not shown) for controlling an air pressure inside chamber 20. The air pressure control subsystem may comprise suitable pumps and valves. Suitable pressure control subsystems are well-known to practitioners of the art.

The terms "aseptic" and "sterilize" and their derivatives are to be understood as follows for the purposes of the present specification. Establishing an aseptic condition in the interior of a chamber shall be understood to mean establishing that condition throughout the internal atmosphere of the chamber as well as on substantially all exposed interior surfaces of the chamber. This shall include the surfaces of all items, containers, subsystems and the like exposed to the interior atmosphere of the chamber. To the extent that extremely tight crevices or microscopic crevices may exist in the interior of the chamber such that a sterilizing gas or vapor may not perfectly penetrate into such tight regions, for example, the degree of sterilization in practical cases may not be total. This is acknowledged in both the industry and in the standards set for the industry. The action of establishing an aseptic condition within the interior of the chamber and "sterilizing the interior of the chamber" shall have the same meaning in this specification.

Introducing into the interior of a chamber with an aseptic condition an item of which the surfaces are not suitably sterilized destroys the existing aseptic condition within the chamber. Conversely, introducing an aseptic or sterilized item into an interior of a chamber that does not have an aseptic condition within that interior does not render that interior aseptic. In fact, all it does is to destroy the aseptic condition of the surface of the item so introduced. Similarly, introducing filtered air, even with all biological entities filtered out, into an unsterilized chamber does not in any way sterilize the chamber or render it aseptic to a degree acceptable in the pharmaceutical industry. The reason is that the interior surfaces of the chamber are not sterilized by the introduction of such air. All that is achieved is to contaminate the filtered air with active biological species resident on the interior surfaces of the unsterilized chamber.

In the interest of clarity and completeness, it should also be recorded that in the art the term "aseptic" is also sometimes used in association with the introduction of pharmaceutical fluids along aseptic tubes into bodies within controlled chambers. In such cases the term in the art refers to the condition inside the tube or to the fact that the pharmaceutical fluid may be filtered to a suitable degree. This in no way sterilizes or renders aseptic the interior of the chamber in question. The aseptic condition in such cases is confined to the interior of the tube bearing the pharmaceutical stream. Such streams are often filtered to a high degree, but such filtering affects only the interior of the particular tube and does not in any way sterilize the interior of the chamber.

In some prior art systems, containers introduced into a chamber for the purposes of being filled with a pharmaceutical are routed through sterilizing subsystems. This kills biological species on the containers. When such sterilized containers are introduced into the chamber when the chamber itself is not aseptic the containers lose their aseptic condition as biological species contained within the chamber will deposit on the previously aseptic containers.

It should also be pointed out that pharmaceutical or semiconductor clean rooms of any quality level, including "Class 100", "Class 10" or "Class 1", even when employing laminar flow hoods and the like or any quality of HEPA (High Efficiency Particulate Air) filters or ULPA (Ultra Low Particulate Air) filters, cannot constitute an aseptic chamber because they do not have an assurable means to render the surfaces of the room sterile or aseptic. Standards for clean rooms exist from both the United States Federal Government and ISO (International Standards Organization). These specify in great detail to different standards the allowed particulate content of a cubic volume of air in such a clean room facility. None of these standards address the matter of biological species present on surfaces in the room. This serves to make the point that a chamber cannot be rendered aseptic by the management of its atmosphere or airflow only. Nor, conversely, can the chamber be rendered aseptic by the sterilization of only the surfaces of its interior.

The text "Guideline for Disinfection and Sterilization in healthcare Facilities, 2008" by Rutala et al from the Center for Disease Control lists a compendium of mechanisms and methods for sterilization. Our concern in this specification is specifically with those mechanisms for sterilizing the interior of a chamber; that is, sterilizing both the interior surfaces and the atmosphere within the chamber. Given the requirements, vapor base methods are most appropriate to the task. These include, but are not limited to, treatment with heated water vapor, hydrogen peroxide vapor, ozone, nitrogen dioxide, ethylene oxide, glutaraldehyde vapor or other suitable sterilizing gases and vapors. In one suitable method appropriate to the present invention, the sterilization is by means of hydrogen peroxide vapor which is then flushed using ozone before the chamber is employed in the filling of pharmaceutical containers.

The term "decontamination" as used herein denotes a process for removing or inactivating contamination, including without limitation viruses, bacteria, spores, prions, molds, yeasts, proteins, pyrogens and endotoxins, to acceptable levels. "Decontamination" as used herein includes both sterilization (that is, the destruction of all microorganisms, including bacterial spores to a probability of surviving organisms of typically less than $1:10^6$) and disinfection (that is, the destruction and removal of specific types of microorganisms).

Returning to FIGS. 1A, 1B and 1C, chamber 10 comprises within its interior filling station 40 arranged and configured to hold one or more pharmaceutical containers 60 that are arranged in one or more container nests 62. Fill needle 50 is disposed within the interior of first chamber 10 and is configured for dispensing a pharmaceutical fluid into the one or more container 60. Portal 30 provides access to second chamber 20 described in greater detail below. The pharmaceutical fluid may be supplied via a fluid path (not shown in FIGS. 1A, 1B and 1C) from a suitable source of pharmaceutical fluid. Such a source (not shown in FIGS. 1A, 1B and 1C) may be disposed within chamber 10 or may be disposed outside chamber 10. Containers 60 shown in FIGS. 1A, 1B and 1C are syringes, but may in general be any other suitable pharmaceutical container, including without limitation cartridges. Suitable first chambers are described in detail in U.S. patent application Ser. No. 13/744,408, U.S. patent application Ser. No. 15/680,114, U.S. patent application Ser. No. 16/356,734, U.S. patent application Ser. No. 17/005,606 and U.S. patent application Ser. No. 17/681,810, the disclosures of all of which are herewith incorporated in full by reference herein.

The term "fluid" as used herein denotes any liquid and any mixture of solids in liquid that has fluid attributes, such as flowability or having appreciable fluidity at ambient temperature and pressure, including, without limitation, a dispersion of a solid or solids in a liquid, an emulsion, a slurry, a micro-emulsion, colloidal suspension, a suspension, a suspension of liposomes, and a suspension of micelles or the like.

The term "fluid path" as used herein denotes any single channel or multi channel tubing or other pathway or structure, rigid or flexible, for transporting a fluid. Examples of suitable fluid paths are described in detail in U.S. patent application Ser. No. 14/890,223, now U.S. Pat. No. 9,993,815, U.S. patent application Ser. No. 15/898,641, now U.S. Pat. No. 10,688,484, U.S. patent application Ser. No. 16/799,767, now U.S. Pat. No. 11,148,130, and U.S. patent application Ser. No. 17/502,884, now U.S. Patent Publication No. 2022-0097035 A1, the disclosures of all of which are herewith incorporated in full by reference herein.

Returning to FIG. 1A, robotic arm 70, with end effector 72, within first chamber 10 is disposed to move and relocate container nests 62 bearing containers 60 (See FIG. 1B). To this end, container nests 62 may be held in container nest frame 22. Robotic arm 70 may also be disposed to move and relocate closure nests 82 bearing closures 80 (See FIG. 1B). To this end, closure nests 82 may be held in closure nest frame 24. Robotic arm 70 may be hermetically sealed within and to chamber 10, and thus function to move the nested materials. Suitable robotic arms 10 have been described in detail in U.S. patent application Ser. No. 14/377,696, now U.S. Pat. No. 11,065,759, U.S. patent application Ser. No. 16/223,003, now U.S. Pat. No. 10,857,666, and U.S. patent application Ser. No. 17/486,693, now U.S. Patent Publication No. 2022-0111510 A1, the disclosures of all of which are herewith incorporated in full by reference herein.

FIG. 1B shows second chamber 20 in more detail. Container nest 62 bearing containers 60 may be held in container nest frame 22. During filling, sealing, and subsequently up to their use, containers 60, which may for example without limitation be tubular syringe bodies, are sealed at their lower ends with caps 64. Container nest frame 22 is movable in a vertical direction by ram 25. Ram 25 is driven along a vertical axis by linear motion shaft 27, as shown by arrow 23. Ram 25 may be hermetically sealed to second chamber 20 by bellows 29. Closure nest 82 bearing container closures 80 may be held in closure nest frame 24, with each closure 80 positioned above a corresponding container 60, for example without limitation with closures 80 being aligned with corresponding containers 60, and/or closures 80 being concentrically disposed with corresponding containers 60. Chamber 20 further comprises, for each closure locating position in closure nest 82, closure pushing pin 26 mounted to an interior roof of second chamber 20 and disposed to stop the corresponding closure 80 from being pushed further vertically when ram 25 is pushed upward. Chamber 20 further comprises closure nest restraining element 28. In the embodiment shown in FIG. 1B, closure nest restraining element 28 is a bowed flexure, although other shapes and configurations of such a flexure may alternatively be employed, for example without limitation cantilever, leaf spring, coil spring and the like arrangements. Such a flexure is positioned to resiliently engage at least one of the nests and/or nest holding facilities rather than with the elements involved with filling and sealing. Closure nest restraining element 28 and its method of use are described in more detail below.

When ram 25 is pushed upward, closure nest restraining element 28 contacts closure nest 82 and ensures that closure nest 82 is firmly confined along a vertical axis within closure nest frame 24 while closures 80 are pushed into the corresponding containers 60 by closure pushing pins 26, thus restraining closure nests 82 for moving vertically relative to container nests 62 during sealing. In other embodiments, alternative restraining mechanisms may be employed to restrain closure nest 82 from being lifted out of frame 24. In other embodiments, alternatives to bellows 29 may be employed to obtain an aseptic and vacuum tight seal between ram 25 and second chamber 20.

FIG. 1C is a cross-section in a vertical plane of an implementation of some of the elements of the container sealing arrangement shown in FIG. 1B, with all numbered elements in FIG. 1C corresponding to those given in FIG. 1B. FIG. 1C does not show the full vertical extent of container nest frame 22, nor does it show any elements of ram 25 or the elements that drive it. For the sake of clarity and focus, FIG. 1C shows container and closure nests 62 and 82, one container 60, one closure 80, two nest frames 22 and 24, one closure pushing pin 26, and closure nest restraining element 28.

Closure nest restraining element 28 may comprise one or more elastically deformable portions. In the embodiment shown in FIG. 1C, closure nest restraining element 28 comprises two elastically deformable portions 282A and 282B. Closure nest restraining element 28 may further comprise one or more closure nest engagement portions. In the embodiment shown in FIG. 1C, closure nest restraining element 28 comprises two closure nest engagement portions 284A and 284B. Closure nest restraining element 28 may further comprise one or more mounting portions. In the embodiment shown in FIG. 1C, closure nest restraining element 28 comprises one mounting portion 286 disposed for mounting closure nest restraining element 28 to an interior roof of second chamber 20.

In operation, with chamber 20 under suitable vacuum, linear motion shaft 27 extends vertically and, in doing so, remains aseptically and vacuum-tight sealed to chamber 20 by bellows 29. In this process, ram 25 moves upward and vertically displaces container nest frame 22 bearing container nest 62 with containers 60, together with closure nest frame 24 bearing closure nest 82 and closures 80. This displacement causes closures 80 to make contact with corresponding closure pushing pins 26. With ram 25 continuing its upward movement and closure nest restraining element 28 securing closure nest 82 in closure nest frame 24 by means of closure nest engagement portions 284A and 284B, closure pushing pins 26 push closures 80 out of closure nest 82 and into containers 60 to a predetermined depth. During upward vertical displacement of ram 25, elastically deformable portions 282A and 282B of closure nest restraining element 28 elastically deform. However, in this process, closures 80 may become stuck on closure pushing pins 26.

The term "elastically deformable" is used herein to describe an object, or portion of an object, that (i) under the action of an applied force external to the object or portion of the object changes shape from an original shape to a deformed shape, and that (ii) returns due to its own elastic material properties to its original shape when the applied force is removed. The term "elastically compressible" is used herein to describe an object, or portion of an object, that (i) under the action of an applied force external to the object or portion of the object reduces its original extent along the axis of the applied force, and that (ii) restores due to its own elastic material properties to its original extent along said axis when the applied force is removed. This behaviour is maintained as long as the material of the object or portion of the object is deformed only within limits dictated by the particular material of the object or portion of the object. An object may, but not necessarily, have both the characteristics of being 'elastically deformable' and 'elastically compressible' as these characteristics are mutually compatible. By way of non-limiting example, many polymeric materials are elastically deformable and elastically compressible. Coiled springs of various materials are elastically compressible along a longitudinal axis within the limits of their individual elastic materials properties. As the extent of elastic deformation or compression is increased due to the applied force, the object or portion of the object exerts a commensurate counter-force opposing the deformation or compression.

When, as part of the vacuum sealing process, the air pressure is again increased in chamber 20 and ram 25 lowered, closures 80 are held in the containers by the pressure difference, but could potentially remain stuck on closure pushing pins 26. In the absence of closure nest restraining element 28, a plurality of containers 60, now held on closures 80 by air pressure and friction, could potentially be lifted out of container nest 62, they could make contact with the (now empty) closure nest 82, and they could lift closure nest 82 out of closure nest frame 24. Closure nest 82 would thus also become indirectly stuck on closure pushing pins 26. Some containers 60 might, under these circumstances, fall and break as they hit the floor of chamber 20, resulting in a wasted product and process stoppage.

Figure 1D:
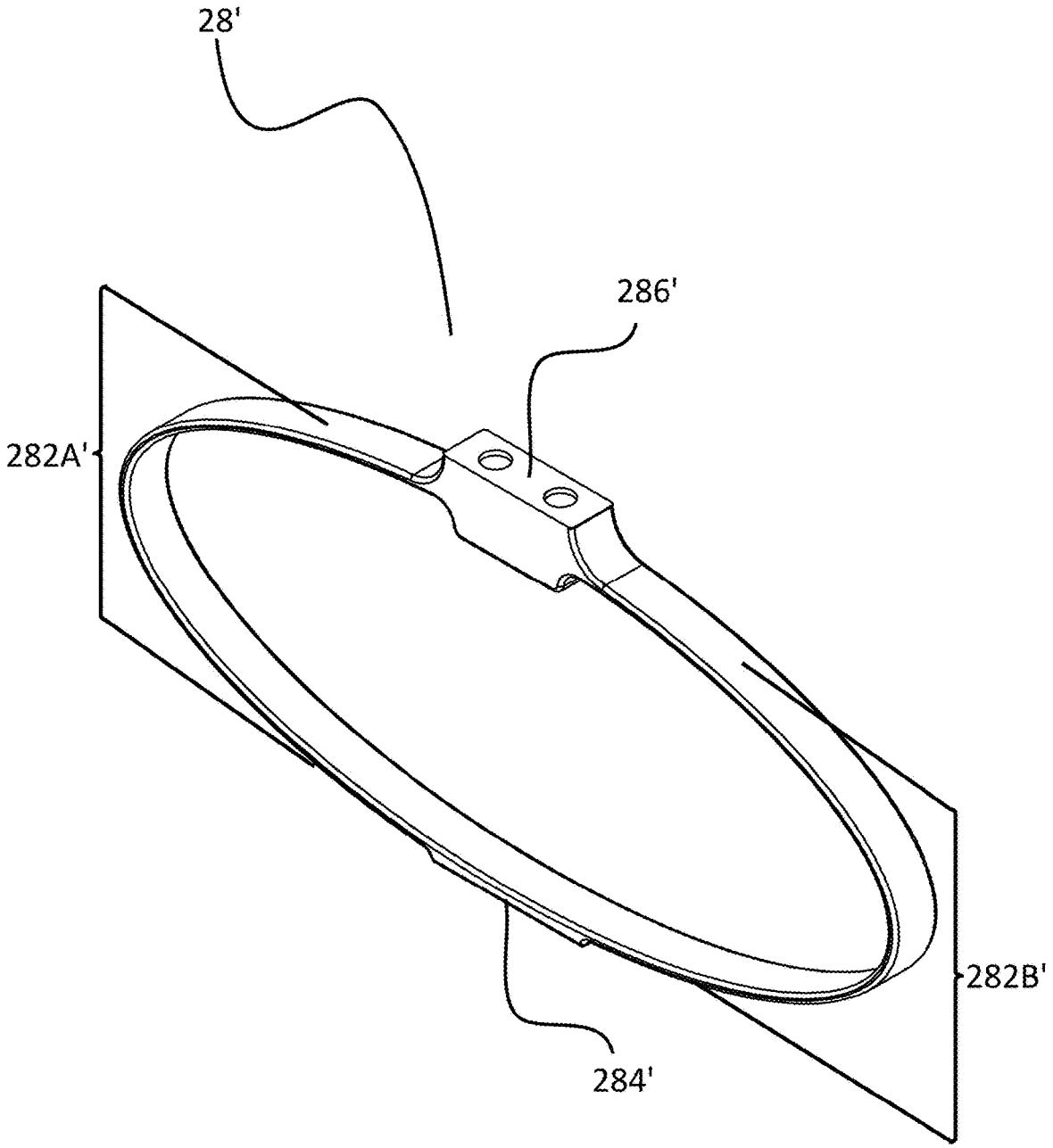
FIG. 1D is an isometric view of a cross-section in a vertical plane of an alternative implementation of the container sealing arrangement shown in FIG. 1B employing an alternative closure nest restraining element.

Closure nest restraining element 28 restrains closure nest 82 from being lifted out of closure nest frame 24. Closure nest 82, thus restrained, in turn serves as a vertical motion restraint for the containers 60, opposing vertical motion of containers 60 and ensuring that containers 60 remain located in the container nest 62 during the sealing process. This arrangement dispenses with the need for any mechanical element of apparatus 100 to be inserted between closure nest 82 and containers 60 in order to prevent the lifting of containers 60 and possibly, associated with such motion, container nest 62. This drastically simplifies the sealing process, reducing expensive process failures. FIGS. 1B, 1C and 1D show that opposing any vertical upward motion of any one of the plurality of containers 60 comprises restraining closure nest 82, for example without limitation, by means of mechanical element 28 of the sterilizable chamber disposed on an opposing side of closure nest 82 from container nest 62.

In another embodiment, system 100 may employ closure nest restraining element 28' shown in FIG. 1D. In this embodiment, closure nest restraining element 28' comprises two elastically deformable portions 282A' and 282B'. Closure nest restraining element 28' comprises a single nest engagement portion 284' and one mounting portion 286' disposed for mounting closure nest restraining element 28' to an interior roof of second chamber 20. In this embodiment, closure nest restraining element 28' functions in the same role as closure nest restraining element 28 of FIG. 1C, with the difference that it is by means of engagement portion 284' that closure nest restraining element 28' secures closure nest 82 in closure nest frame 24. During upward vertical displacement of ram 25, elastically deformable portions 282A' and 282B' of closure nest restraining element 28' elastically deform to produce a force required to restrain closure nest 82 in closure nest frame 24.

Flexures 28 and 28' may mechanically bias closure nest 82 and container nest 62, for example without limitation by moving between a first undeflected configuration to a second deflected configuration as container nest 62 is moved towards closure nest 82. In other embodiments, closure nest 82 may push against containers 60 and, in some cases, indirectly (via containers 60) against container nest 62 if the latter was dragged upward with containers 60 by the returning air pressure acting on closures 80.

Figure 1E:
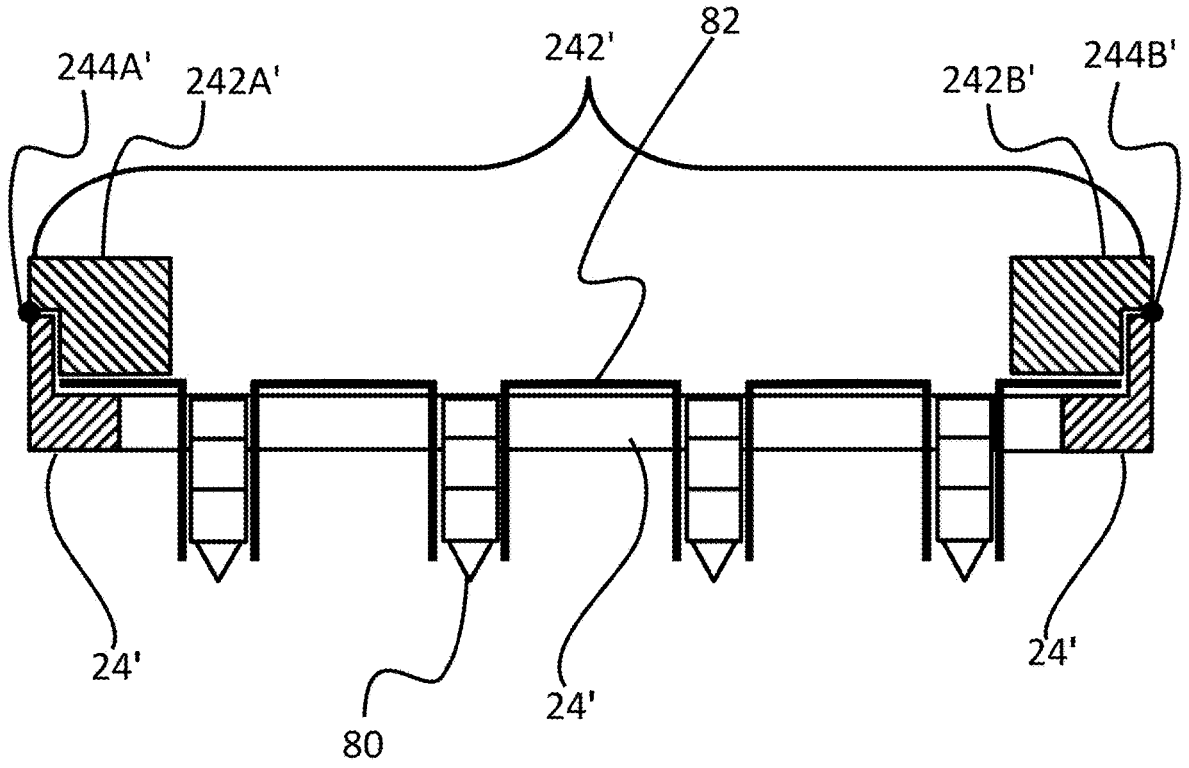
FIG. 1E is a cross-section in a vertical plane view of a further implementation of the container sealing arrangement shown in FIG. 1B employing as part of a closure nest frame a closure nest restraining element for mechanically confining along a vertical axis the closure nest of FIG. 1B.

In a further embodiment, system 100 may employ the closure nest restraining arrangement shown in FIG. 1E. In this embodiment, the closure nest restraining element is not required to comprise any elastically deformable portions. In this embodiment, closure nest 82 is releasably retained in closure nest frame 24' by means of closure nest engagement elements 242A' and 242B' which are hinged to closure nest frame 24' of system 100 by respectively hinge 244A' and hinge 244B'. Closure nest engagement elements 242A' and 242B' are engaged with closure nest 82 before closure nest 82 is transferred into chamber 20 in the associated method described below. In FIG. 1E only two closure nest engagement elements 244A', 244B' and hinges 242A', 242B' are shown, engaging the left- and right-hand perimeter areas of closure nest 82 respectively. In other embodiments, closure nest frame 24' may have at least two further closure nest engagement elements for engaging with the proximal and distal perimeter areas of closure nest 82 (not visible in the cross-sectional drawing in FIG. 1E). In FIG. 1E, closure nest restraining element 242' comprises closure nest engagement elements 242A' and 242B', optionally along with the corresponding proximal and distal closure nest engagement elements described here.

The three embodiments shown in FIGS. 1C, 1D and 1E have in common the characteristic of spatial securement of closure nest 82 within closure nest frame 24, 24', whether by elastically deformable closure nest restraining elements attached to the interior roof of chamber 20 (as in FIGS. 1B, 1C and 1D), or by mechanical confinement along a vertical axis by closure nest engagement elements attached to the closure nest frame as in FIG. 1E. In all three cases, the elements of system 100 are disposed to allow closure nest 82 to dislodge the closures from closure pushing pins 26. This will be explained in more detail below.

In one embodiment, the hermetic sealing provided by chamber 10 is sufficient to satisfy predetermined requirements according to ISO standard ISO10648-2, entitled "Containment Enclosures Part 2—Classification According to Leak Tightness and Associated Checking Methods." Specifically, the sealing is preferably sufficient to satisfy Class 3, or more preferably Class 2, or even more preferably Class 1. In another embodiment, the hermetic sealing provided by chamber 10 is sufficient to satisfy predetermined requirements according to PDA Journal of Pharmaceutical Science and Technology Technical Report no. 34, entitled "Design and Validation of Isolator Systems for the Manufacturing and Testing of Health Care Products" (September/October 2001). The disclosures of both of these documents are herein incorporated by reference.

On page 2 of the ISO10648-2 document the four classes of leak tightness for containment enclosures are defined as follows in terms of leak rates. "Class 4" describes a system with a leak rate of less than $10^{-1}$ per hour. "Class 3" describes a system with a leak rate of less than $10^{-2}$ per hour. "Class 2" describes a system with a leak rate of less than $2.5\times10^{-3}$ per hour. "Class 1" describes a system with a leak rate equal to or less than $5\times10^{-4}$ per hour. PDA document no. 34 does not define classes, but specifies on page 8 a single leak rate of "not more than 0.5% of isolator internal volume over one hour". PDA document no. 34 therefore prescribes a leak rate equal to or less than $5\times10^{-3}$ per hour, placing it squarely between Class 2 and Class 3 of the ISO10648-2 document.

In some embodiments, second chamber 20, which has to maintain an active vacuum during the sealing process, may have a leak rate equal to or less than 1.54 millibar·liter per second. In other embodiments, second chamber 20 may have leak rates equal to or less than 0.3 millibar·liter per second. In yet further embodiments, chamber 20 may have a leak rate of equal to or less than 0.02 millibar·liter per second. These leak rates also particularly apply to bellows 29 and portal 30.

Figure 2:
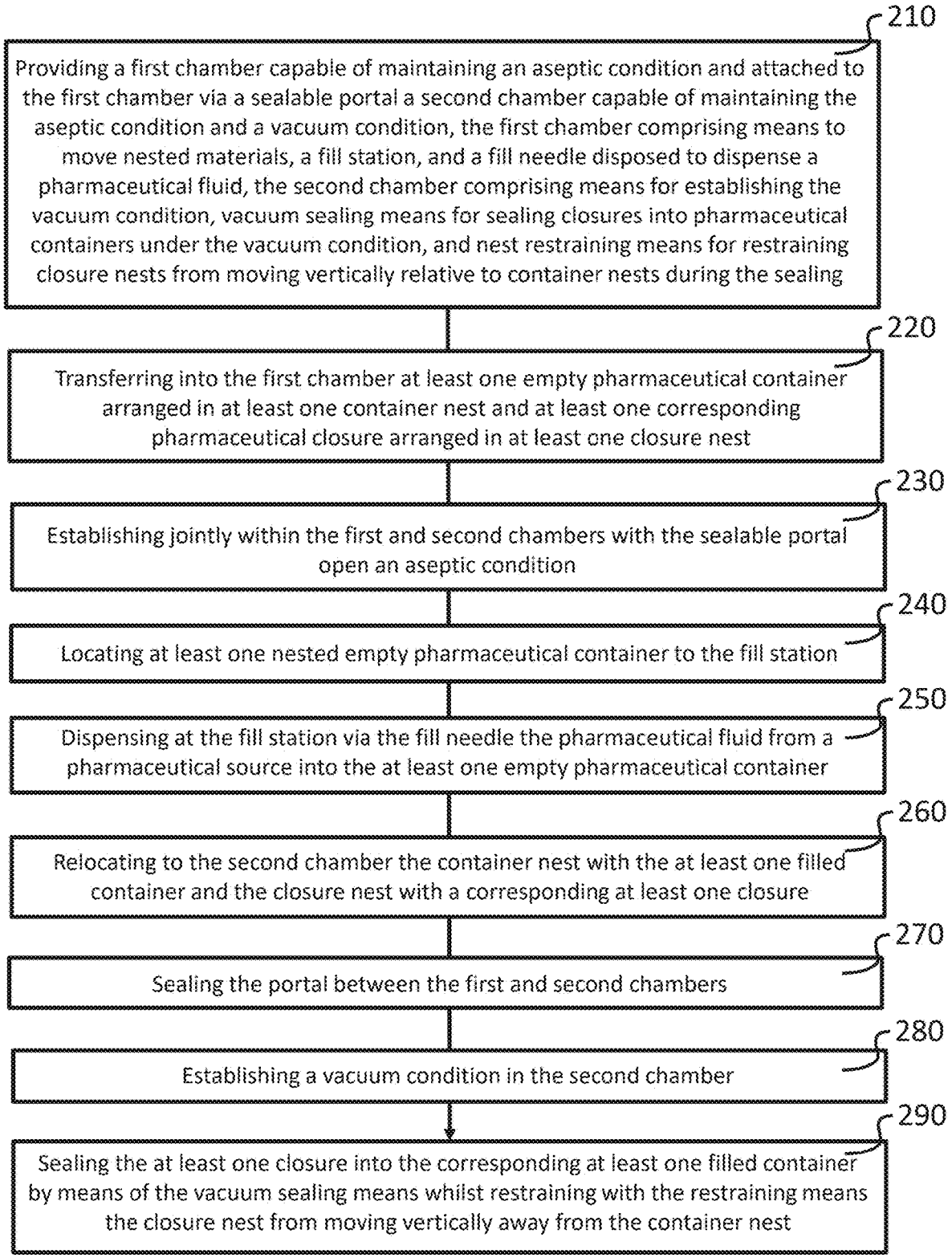
FIG. 2 is a flow chart for a method for filling syringes with a pharmaceutical fluid and vacuum sealing the fluid into the syringes by means of closures.

As per the flow chart in FIG. 2, method 200 comprises (i) providing 210 first chamber 10 capable of maintaining an aseptic condition, the first chamber being attached via sealable portal 30 to second chamber 20 also capable of maintaining the aseptic condition and a vacuum condition, first chamber 10 comprising means 70 to move nested materials, fill station 40, and fill needle 50 disposed to dispense a pharmaceutical fluid, second chamber 20 comprising means for establishing the vacuum condition, vacuum sealing means for sealing closures 80 into pharmaceutical containers 60, and nest restraining means 28, 28', 242' for opposing vertical upward motion of closure nests 82 during the sealing; (ii) transferring 220 into first chamber 10 at least one empty pharmaceutical container 60 arranged in at least one container nest 62 and at least one corresponding pharmaceutical closure 80 arranged in at least one closure nest 82; (iii) establishing 230 jointly within first chamber 10 and second chamber 20 with sealable portal 30 open an aseptic condition; (iv) locating 240 at least one nested empty pharmaceutical container 60 to fill station 40; (v) dispensing 250 at fill station 40 via fill needle 50 the pharmaceutical fluid from a pharmaceutical source into the at least one empty pharmaceutical container 60; (vi) relocating 260 to second chamber 20 container nest 62 with the at least one filled container 60 and closure nest 82 with a corresponding at least one closure 80; (vii) sealing 270 portal 30 between first chamber 10 and second chamber 20; (viii) establishing 280 a vacuum condition in second chamber 20; and (ix) sealing 290 the at least one closure 80 into the corresponding at least one filled container 60 by means of the vacuum sealing means whilst restraining with restraining means 28, 28', 242' closure nest 82 from moving vertically away from container nest 62.

Opposing any vertical upward motion of any one of the plurality of containers 60 comprises restraining closure nest 82 by means of a mechanical element (for example without limitation, closure nest restraining element 28,28', or 242' of sterilizable chamber 20 disposed on an opposing side of closure nest 82 from container nest 62). In the particular implementations shown in FIGS. 1B, 1C and 1D, opposing any vertical upward motion of any one of the plurality of containers 60 comprises restraining closure nest 82 by elastic deformation of a mechanical element (for example without limitation, closure nest restraining element 28 or 28' of FIG. 1C or FIG. 1D respectively) of sterilizable chamber 20 disposed on an opposing side of closure nest 82 from container nest 62. In the particular implementation shown in FIG. 1E, opposing any vertical upward motion of any one of the plurality of containers 60 comprises restraining closure nest 82 by mechanical confinement along a vertical axis by closure nest engagement elements attached to closure nest frame 24' and acting on an opposing side of closure nest 82 from container nest 62.

Relocating 260 may comprise relocating to second chamber 20 container nest 62 with the at least one filled container 60 while container nest 62 is held in container nest frame 22 and relocating closure nest 82 with a corresponding at least one closure 80 while closure nest 82 is held in closure nest frame 24, 24'.

Sealing 290 may comprise (i) inserting closures 80 into the corresponding containers under the vacuum condition and (ii) increasing the air pressure in second chamber 20 after the inserting. Increasing the air pressure in second chamber 20 may comprise equating an air pressure in second chamber 20 and an air pressure in first chamber 10. Equating the air pressure in second chamber 20 and the air pressure in first chamber 10 may comprise at least partially opening sealable portal 30. The increased air pressure in second chamber 20 forces closures 80 along the interiors of containers 60 until closures 80 come into contact with the menisci of the pharmaceutical fluid in containers 60. Inserting the closures under a vacuum condition, as described here, ensures that potentially harmful air bubbles are not trapped between the closures and the pharmaceutical fluid menisci in any of containers 60 during sealing 290.

Providing 210 may further comprise providing within second chamber 20 ram 25 sealed vacuum tight to chamber 20, thereby allowing chamber 20 to be sterilized and free of mechanical debris despite having a mechanical ram operating inside of it, driven by an engine located outside of chamber 20.

Relocating 260 to second chamber 20 may comprise locating closure nest frame 24 with closure nest 82 and closures 80 above container nest frame 22 with container nest 62 bearing containers 60, each closure 80 located vertically aligned with a corresponding container 60.

Inserting of closures 80 into containers 60 may comprise vertically forcing containers 60 upward along the axis of arrow 23 to abut, engage, or otherwise contact with corresponding closures 80 by operation of ram 25 to vertically displace nest frame 22 so as to press closures 80 against closure pushing pins 26.

Inserting of closures 80 into containers 60 may comprise (as in FIGS. 1B, 1C and 1D) effecting a downward pressure on closure nest 82 to prevent closures 80 from being impaled, impacted, or otherwise connected on closure pushing pins 26. Effecting a downward pressure on closure nest 82 may comprise elastically deforming a mechanical member. Elastically deforming a mechanical member may comprise elastically deforming closure nest restraining element 28, 28'. In other embodiments, different arrangements of elastically deformable mechanical members may be employed, including without limitation, spring-based members, elastically compressible members, and the like. In general, the method comprises opposing by means of the closure nest 82 any vertical upward motion of any one of the plurality of containers 60 after the engaging.

ADDITIONAL NOTES

The above detailed description includes references to the accompanying drawings, which form a part of the detailed description. The drawings show, by way of illustration, specific embodiments in which the invention may be practiced. These embodiments are also referred to herein as "examples." All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B"

includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein may be machine or computer-implemented at least in part. Some examples may include a tangible computer-readable medium or machine-readable medium encoded with instructions operable to configure an electronic device to perform methods as described in the above examples. An implementation of such methods may include code, such as microcode, assembly language code, a higher-level language code, or the like. Such code may include computer readable instructions for performing various methods. The code may form portions of computer program products. Further, the code may be tangibly stored on one or more volatile or non-volatile computer-readable media during execution or at other times. These computer-readable media may include, but are not limited to, hard disks, removable magnetic disks, removable optical disks (e.g., compact disks and digital video disks), magnetic cassettes, memory cards or sticks, random access memories (RAM's), read only memories (ROM's), and the like.

The above description is intended to be illustrative, and not restrictive. For example, the above-described examples (or one or more aspects thereof) may be used in combination with each other. Other embodiments may be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

What is claimed is:

1. A method within a sterilizable chamber for sealing a pharmaceutical fluid into a plurality of containers with a corresponding plurality of closures, the method characterized by:

transferring into an isolator that is in spatial communication with the chamber via a sealable portal, the plurality of containers held in a container nest and the corresponding plurality of closures held in a closure nest;

establishing within both the chamber and the isolator an aseptic condition;

in the isolator under the aseptic condition filling the plurality of containers with the pharmaceutical fluid;

transferring into the chamber the container nest holding the pharmaceutical-filled containers and the closure nest holding the corresponding closures;

disposing within the chamber the closure nest above the container nest such that every container to be sealed is aligned and/or located concentrically below a corresponding closure;

vacuum-tight sealing the chamber by means of the portal;

reducing an air pressure in the chamber to a predetermined level to create a vacuum condition;

mechanically engaging the plurality of containers with the corresponding closures under the vacuum condition by forcing the container nest vertically upward;

opposing any vertical upward motion of any one of the plurality of containers after the engaging by establishing contact between the closure nest and a closure nest restraining element disposed on an opposing side of the closure nest from the container nest; and increasing the air pressure in the chamber to force the plurality of closures deeper into the corresponding plurality of containers to establish physical contact between the closures and the pharmaceutical fluid.

2. The method of claim 1, characterized in that opposing any vertical upward motion of any one of the plurality of containers comprises restraining the closure nest by means of a mechanical element of the sterilizable chamber disposed on an opposing side of the closure nest from the container nest.

3. The method of claim 1, characterized in that opposing any vertical upward motion of any one of the plurality of containers comprises restraining the closure nest by elastic deformation of a mechanical element of the sterilizable chamber disposed on an opposing side of the closure nest from the container nest to deter connection of pushing pins with the nests.

4. The method of claim 3, characterized in that the elastic deformation comprises elastic compression.

5. The method of claim 3, characterized in that elastic deformation comprises spring-based compression capable of acting as a spring by storing and releasing energy.

6. The method of claim 1, characterized in that opposing any vertical upward motion of any one of the plurality of containers comprises mechanically confining the closure nest along a vertical axis.

7. The method of claim 1, characterized in that vacuum-tight sealing the chamber comprises vacuum-tight sealing to a leak rate equal or less than 1.54 millibar·liter per second.

8. The method of claim 1, characterized in that vacuum-tight sealing the chamber comprises vacuum-tight sealing to a leak rate equal or less than 0.3 millibar·liter per second.

9. The method of claim 1, characterized in that vacuum-tight sealing the chamber comprises vacuum-tight sealing to a leak rate equal to or less than 0.02 millibar·liter per second.

10. The method of claim 1, characterized in that the establishing contact between the closure nest and a closure nest restraining element is made by a flexure.

11. The method of claim 1, characterized in that the establishing contact between the closure nest and a closure nest restraining element is made by a closure nest restraining element hingedly connected to a closure nest frame.

12. A sterilizable vacuum chamber for sealing a pharmaceutical fluid into a plurality of containers with a corresponding plurality of closures, the chamber characterized by:

a vertically movable container nest holding facility arranged for receiving a container nest bearing a plurality of pharmaceutical containers filled with a pharmaceutical fluid;

a container closure nest holding facility arranged for receiving a closure nest (82) bearing a plurality of corresponding container closures and for locating a closure vertically above each corresponding container in the container nest, a ram for vertically moving the container nest holding facility to engage containers in the container nest with closures in the closure nest;

a closure nest restraining element disposed on an opposing side of the closure nest from the container nest and arranged for engaging with the closure nest.

13. The sterilizable vacuum chamber of claim 12, characterized in that the chamber is sealable to a leak rate equal to or less than 1.54 millibar·liter per second.

14. The sterilizable vacuum chamber of claim 12, characterized in that the chamber is sealable to a leak rate equal to or less than 0.3 millibar·liter per second.

15. The sterilizable vacuum chamber of claim 12, characterized in that the chamber is sealable to a leak rate equal to or less than 0.02 millibar·liter per second.

16. The sterilizable vacuum chamber of claim 12, characterized in that the closure nest restraining element is elastically deformable to deter connection of pushing pins with the nests.

17. The sterilizable vacuum chamber of claim 12, characterized in that the closure nest restraining element comprises at least one compressible spring.

18. The sterilizable vacuum chamber of claim 12, characterized in that the closure nest restraining element is disposed to deform elastically when the closure nest is forced vertically upward against the restraining element.

19. The sterilizable vacuum chamber of claim 12, characterized in that the closure nest restraining element is disposed to mechanically confine the closure nest along a vertical axis.

20. The sterilizable vacuum chamber of claim 12, characterized by a sealable portal disposed for receiving the container nest bearing the plurality of pharmaceutical containers and the closure nest bearing the plurality of corresponding container closures.

21. The sterilizable vacuum chamber of claim 12, characterized in that the closure nest restraining element is disposed to engage the container nest.

22. The sterilizable vacuum chamber of claim 12, characterized in that the container nest holding facility and the closure nest holding facility are aligned.

23. The sterilizable vacuum chamber of claim 12, characterized in that container nest holding facility and the closure nest holding facility are disposed to hold the container nests and the closure nests in alignment.

24. The sterilizable vacuum chamber of claim 12, with the closures held by the closure nest each having a central axis and the containers held by the container nest each having a central axis, characterized in that the alignment of the container nest holding facility and the closure nest holding facility is arranged to concentrically locate corresponding container nests and closure nests.

25. The sterilizable vacuum chamber of claim 12, wherein the closure nest restraining element comprises a flexure capable of mechanically biasing the closure nest and container nest together.

26. The sterilizable vacuum chamber of claim 12, wherein the closure nest restraining element is connected by a hinge to a closure nest frame.

* * * * *